US005092252A

United States Patent [19]

Gillhart

[11] Patent Number: 5,092,252

[45] Date of Patent: Mar. 3, 1992

[54] TRANSPORT PALLET

[76] Inventor: Karl Gillhart, Am Schlossberg, 7481 Hettingen, Fed. Rep. of Germany

[21] Appl. No.: 567,916

[22] Filed: Aug. 15, 1990

[30] Foreign Application Priority Data

Aug. 21, 1989 [DE] Fed. Rep. of Germany ..... 3927502

[51] Int. Cl.[5] ..... B65D 19/18

[52] U.S. Cl. ..... 108/55.1; 108/53.1; 108/55.3

[58] Field of Search ..... 108/55.1, 55.5, 53.1, 108/56.3, 55.3

[56] References Cited

U.S. PATENT DOCUMENTS

| | | | |
|---|---|---|---|
| 3,285,204 | 11/1966 | Schweitzer, Jr. | 108/53.1 X |
| 3,521,764 | 7/1970 | Loomis | 108/53.1 X |
| 3,626,872 | 12/1971 | Cully | 108/55.1 |
| 3,842,534 | 10/1974 | Walters et al. | 108/55.1 X |
| 3,895,588 | 7/1975 | Miller | 108/55.3 X |
| 3,916,803 | 11/1975 | Garcia | 108/55.3 X |
| 4,056,195 | 11/1977 | Keith | 108/55.1 |

*Primary Examiner*—Peter A. Aschenbrenner

[57] ABSTRACT

A transport pallet has a frame with slots located on the inside, into which slots the ends of racks (toothed bars) can be inserted so that very coarse to very fine subdivisions can be made with the same type of rack. The racks can be crossed to give each other a firm fit.

30 Claims, 5 Drawing Sheets

TRANSPORT PALLET

The invention relates to a rectangular transport pallet.

BACKGROUND OF THE INVENTION

Pallets of this type are used both for transporting and for protecting parts on the internal transport path. However, it also happens that these pallets are sent over relatively large distances. The parts sent with them can have different shapes, such as for example rotary parts, shafts, valves, slides, flanges or the like. The parts are smaller than the parts customarily used in large-scale mechanical engineering, but they are larger than the parts used, for example, in precision mechanics. Their greatest dimension is in the range of 30–70 cm and their smallest dimension in the range of 5 mm upwards. Many parts used in general mechanical engineering are in this range.

Hitherto, small wooden pallets or boxes with wooden inserts have been used because wood is available anywhere, wood can absorb impacts, wood is easily machineable and because wood is inexpensive. For example, wooden boards have been provided with holes and cylindrical parts have been inserted in these holes. Shafts were mounted in such a way that V-blocks were nailed to the wooden planks which then served for mounting the shafts.

The disadvantage with these is that they are small wooden pallets for special purposes which cannot be adapted to different applications. Disposal posed difficulties since wood may only be burnt under certain circumstances. Parts located on small wooden pallets cannot be treated, e.g. washed because the wood then becomes wet.

In former times, chipboard was also used, but it did not prove to be efficient either, because aqueous media are used for cleaning. These release acid from the chipboard and then the parts rust.

Then plywood boards were used which do not have this disadvantage. However, the parts must be detached from the plywood boards for cleaning in this case too, and then reinserted in the plywood boards.

In any case, many sorts of pallets are required, which means keeping a large store.

Many of these pallets could not be stacked, and they had to be placed in a box so that the pallets did not slip over one another. If the pallets and their parts were painted, this had to be done relatively frequently in the case of the living material.

OBJECT AND STATEMENT OF THE INVENTION

The object of the invention is to provide a device of the type mentioned at the beginning, which a man of normal build can handle, which is versatile in use, with which the parts can also be left on the pallet if they are intended to come into contact with liquid media and which is also suitable for automatic handling.

Pallets of this type have a bottom side including a planar area, and have dimensions in the lower range of square decimeters up to a large number of square decimeters. The planar area includes four corner regions. The transport pallet has spacer devices on the bottom side for spacing the transport pallet from an adjacent transport pallet.

According to the invention, this object of the invention is achieved by the following features:

a metallic frame covered with a protective coating that comprises four frame legs disposed in two pairs of approximately parallel frame legs, said pairs being approximately perpendicular to one another, said frame legs having receptacles extending approximately perpendicular to said planar area which receptacles in each frame leg are open towards an approximately parallel frame leg and have approximately the same shape as each other, said receptacles of each of said frame legs being in an opposed arrangement to said receptacles of a respective approximately parallel frame leg and having an open space between said receptacles, racks insertable at their ends in said receptacles, which racks have sides with teeth at least on one of said sides, with teeth gaps aligned with receptacles in frame legs approximately parallel to said racks, said teeth gaps being wider than said racks are thick, said racks having a length slightly shorter than said open space between opposite receptacles in said approximately parallel frame legs including receptacle depth.

The described embodiments include the following additional advantageous features. Said frame legs comprise an inside and an outside, a U-shaped profile that is open toward said outside, an inside transverse web that extends substantially perpendicular to said planar area and top and bottom longitudinal flanges that extend approximately parallel to said planar area, wherein said receptacles comprise slots that, in length, are machined out of said transverse web and, in depth, out of at least said top longitudinal flange. By these features, material is saved, at the same time a peripheral gripping trough is provided. Disadvantages are avoided which arise when cavities can be filled and rust, and the receptacles can be mounted systematically and in a simple manner.

Said transverse web has a center, and said receptacles comprise slots starting from both said top longitudinal flange and said bottom longitudinal flange and extend in the direction of said center of said transverse web, which slots are aligned in pairs seen perpendicular to said transverse web, and wherein said transverse web has a material bridge between each pair of slots. By these features, racks can be inserted both from below and from above, and these racks can have a low height. Additionally, the racks can be inserted, on the one hand, with their backs towards each other or with their teeth towards each other, which results in advantages in the holding method.

Said bridge is located in said center of said transverse web. By this feature, no upper or lower racks of different height are required, and it is also irrelevant which way round the frame is used.

Center spacing from receptacle to receptacle is in the range of 5–15 mm. By this feature, a sufficiently fine subdivision is achieved on the one hand without weakening the frame legs on the other hand.

Said receptacles are higher than they are wide. By this feature, a reliable safeguard against tilting is obtained.

Said racks are not substantially higher than said receptacles. By this feature, an essentially evenly flat top side is obtained in the region of the top side of the frame.

Said receptacles have stop surfaces, and said ends of said racks in an inserted state butt against said stop surfaces of said receptacles, which stop surfaces limit longitudinal movement of said racks. By these features, the racks are prevented from moving longitudinally without additional construction elements.

Said stop surfaces comprise a base of said slots in said longitudinal flanges. By this feature, a particularly simple stop surface is obtained, which is present in any case by reason of producing the slots or receptacles.

Said racks are metallic and are covered with a protective coating. By these features, racks do not corrode. If relatively soft protective coatings are used, such as for example polyamide, no rattling noises occur. Additionally, the protective coating can be given a color—which is usually the case—and the cartesian arrangement of the racks can be used for transport control, for automatic loading and unloading or the like. This is because the racks form a high-lighted recognizable pattern. In this case, a separate color is used for the racks, e.g. white, which is readily recognizable while the other parts have a common different color, such as for example orange.

A holding-down frame is attached to said frame, which holding-down frame overlaps said receptacles and said ends of said racks at least partially and prevents said racks from coming out of said transport pallet. By these features, the racks can be secured after they have been inserted.

A screen extends parallel to said planar area, attached to said holding-down frame. By this feature, parts which are very small are prevented from falling out.

Said holding-down frame is made in one piece and has four metal legs. By these features, a particularly simple holding-down frame is obtained which can be produced from a flat metal sheet.

Reinforcement pieces are connected rigidly to said four corner regions, provided in said frame legs in said four corner regions, and first feet are attached at least indirectly to said reinforcement pieces at least in one direction perpendicular to said planar area by means of an attachment device. By these features, ease of stacking is obtained, and the feet are situated at places in which force can readily be introduced and at which they are not in the way.

Said first feet are adapted for stacking one of said transport pallets upon another. By this feature, the transport pallet can also be stacked even if there are no lateral guide surfaces, such as for example box walls. The stack then supports itself.

Said first feet have a surface on which said transport pallet is arranged to stand and a recess open toward said standing surface. By these features, a simple, positive-fit connection, which can be detached at any time, is obtained between two transport pallets.

Said recess is cylindrical. By this feature, a positive fit is equally effective on all sides.

Said attachment device has securely fitting elements. By this feature, at least for the forces occurring primarily, the requirement for springs, magnets or the like as securing means, which can lose their effect in a corrosive environment, is avoided.

Said attachment device has an internal thread in said reinforcement pieces, and said first feet each has a threaded bolt that is adapted to screw into said internal thread in said reinforcement pieces. By these features, the attachment devices can be produced in a particularly simple manner. No type of operation needs to be remembered as would be the case, for example, with bayonet connections, and they can be screwed in as far as necessary irrespective of whether further objects have to be fastened by the attachment device, such as for example the holding-down frame, a screen, handles, spacers or the like.

Said holding-down frame has four corner regions and perforations in said four corner regions. Portions of said feet pass through said perforations, and said first feet have pressure surfaces facing said corner regions that press said holding-down frame onto said corner regions. By these features, attachment devices can be mounted both from above and from below and, additionally, production is simplified as perforations are easier to produce than blind boreholes. Additionally, the underside of the frame can be used as the topside or the topside as the underside.

Said internal thread is a coarse-pitch thread in the self-locking range. By this feature, the attachment of the feet is achieved with relatively few rotations.

Said internal thread is a round thread. By this feature, a robust, very frequently usable thread is obtained which does not lose its effect even if it is comparatively severely damaged.

Said first feet are substantially cylindrical. By this feature, it is irrelevant which position the feet have in relation to their geometric longitudinal axis.

Said first feet have a surface suitable for manual attaching said first feet to said reinforcement pieces. By this feature, the feet can be handled more easily.

Said feet surface is grooved. By this feature, an indication is obtained as to where the feet are to be gripped and an easily produceable surface form is obtained.

Second feet of a type different from said first feet are attached in said four corner regions, aligned with and opposite said first feet, which have an annular collar with a larger diameter than said recess. By these features, no intermediate pieces are required between the feet. The first type of feet fits in any case into the second type of feet and vice versa.

Each of said second feet has a cone end for inserting said second feet into said recess in said standing surface on an adjacent transport pallet, said cone end being in front of said annular collar in a direction towards said standing surface on said adjacent transport pallet. By these features, the stack fitting can be relatively good and, nevertheless, it is not necessary to search for too long for the recess which is usually invisible in any case.

A moveable handle is on two mutually parallel frame legs. By this feature, the transport pallet can be handled in a simple manner, in particular when it is transported in a box, in which there is no gripping possibility from the side.

Said moveable handle comprises a cable. By this feature, a simple handle is obtained and the handle can easily be put in the correct position due to the mobility of the cable.

Said frame legs each has a top side, and cable loops are provided at two ends of said cable, said cable loops being attachable to feet, including said first and said second feet on said top side. By these features, no particular attachment point is required for the handle. It can be omitted or used and it is irrelevant whether only the frame is to be transported or whether the latter also has a holding-down frame, a screen or the like.

DESCRIPTION OF THE DRAWINGS

The invention is now described with reference to a preferred exemplary embodiment shown in the drawing, in which.

DESCRIPTION OF PREFERRED EMBODIMENTS

Figure 1:
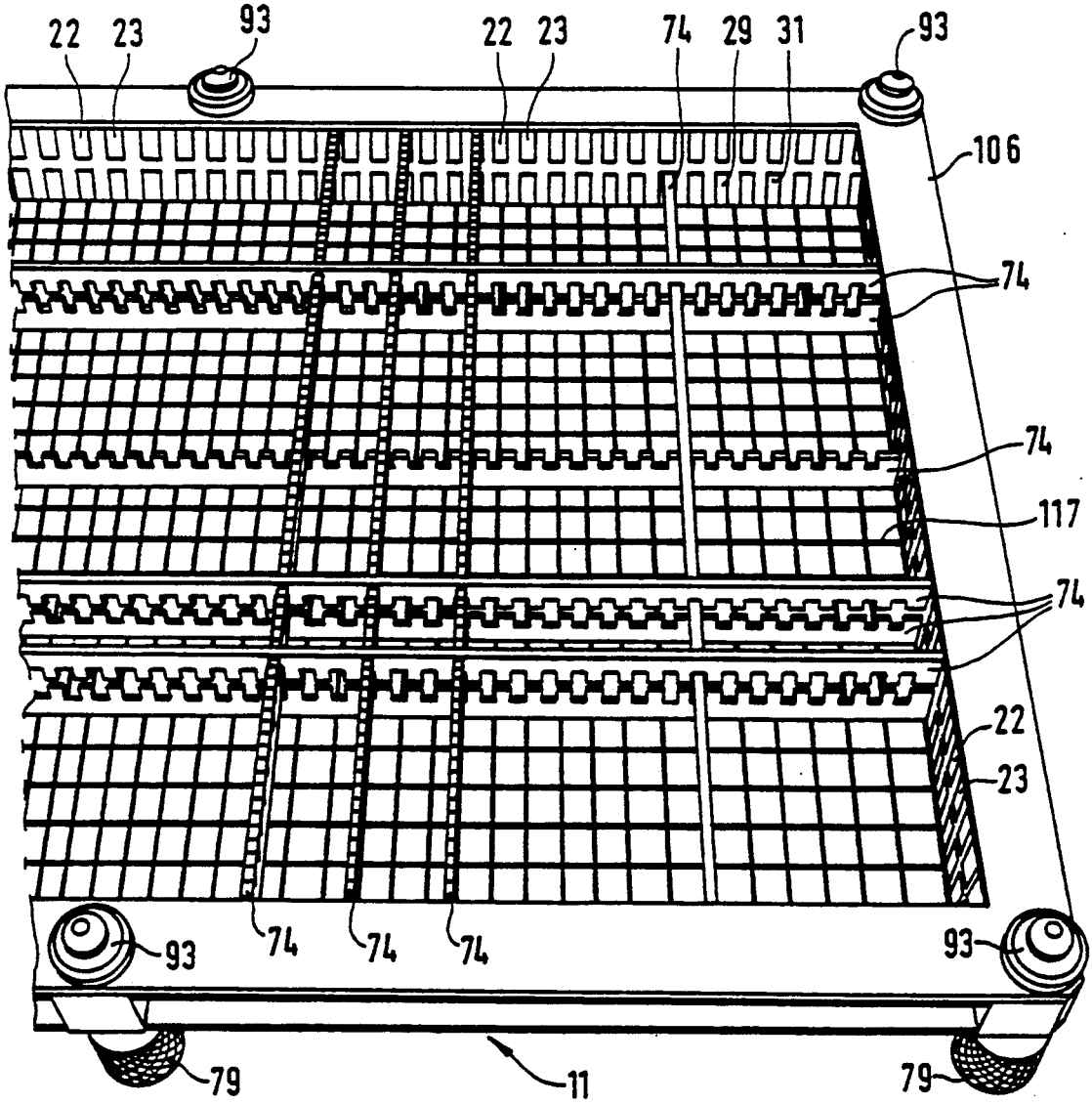
FIG. 1 shows a perspective partial view of a device according to the invention having screen, holding-down frame, inserted racks and machine parts to be transported.

A frame 11 has four frame legs 12, 13, 14, 16. The two frame legs 13 and 16 are situated parallel to each other and, at right angles to them are the parallel frame legs 12, 14. The frame leg 13 is about 480 mm long and the frame leg 12 is about 310 mm long.

Figure 2:
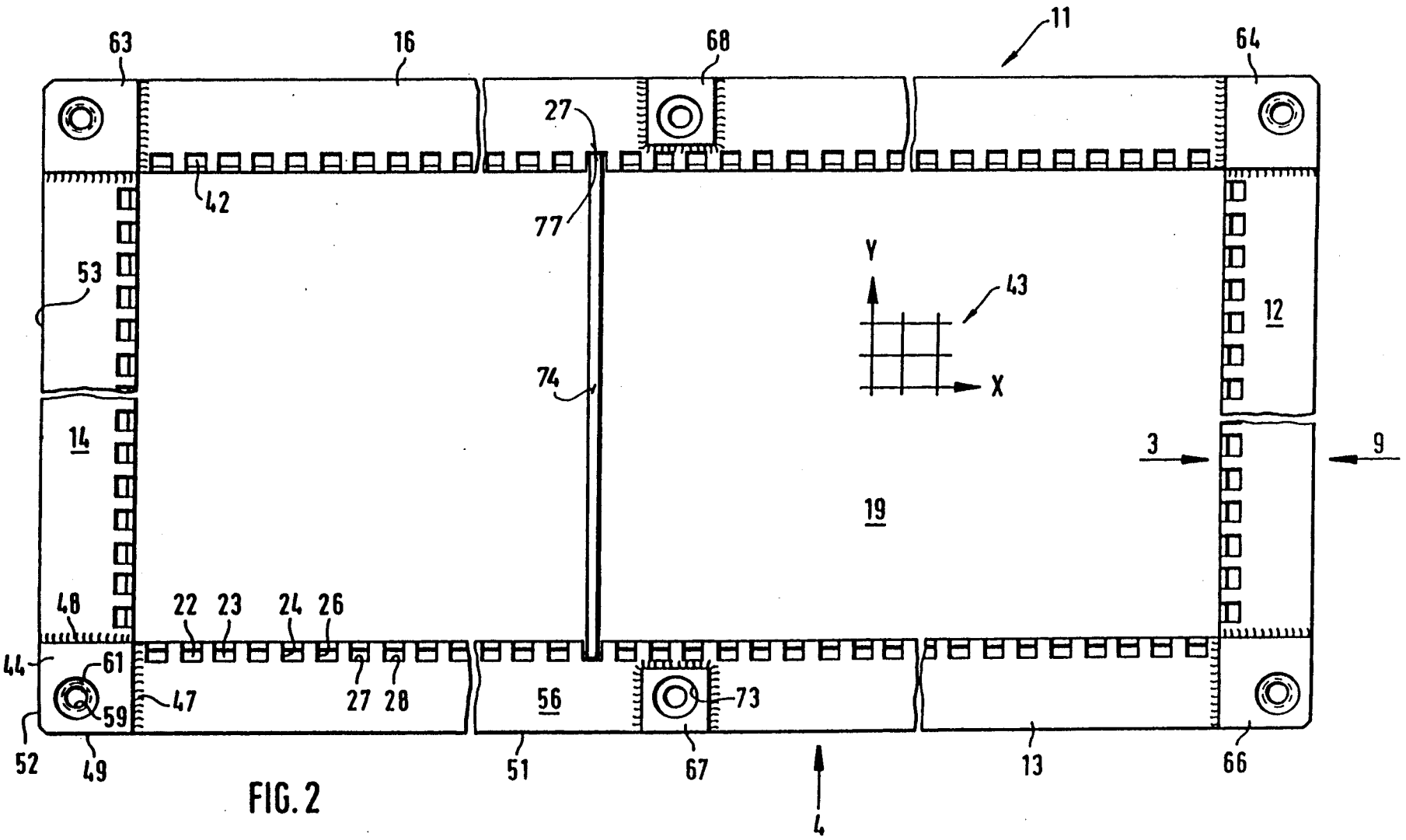
FIG. 2 shows the partially cut open plan view of a frame.

The frame leg 13 has two horizontal flat longitudinal flanges 17, 18 which are arranged parallel to each other and are parallel to the plane 19 of the drawing of FIG. 2. Towards the inside, the longitudinal flanges 17, 18 merge into a transverse web 21. A U-shaped profile, bent at right angles, is thus obtained.

With a center spacing of 9 mm, a plurality of slots 22, 23 is provided which are 6 mm wide. The slots 22, 23 are not only situated in the transverse web 21, but extend with a 5 mm deep, rectangular extension 24, 26 some distance into the longitudinal flange 17 so that a stop surface 27, 28 is formed there, which is as high as the thickness (1.5 mm) of the longitudinal flange 17. Further slots 29, 31 are machined in from below (see FIG. 4), these being symmetrical to the central plane 32. The slot 22 is situated directly above the slot 29 and the slot 23 is situated directly above the slot 31. However, both are separated from each other from the top to the bottom by bridges 33, 34. Thus the slots 22, 23 have support surfaces 36, 37 facing upwards in the transverse web 21 and, in parallel and directly below said surfaces, the slots 29, 31 have resting surfaces 38, 39 facing downwards. In relation to each other, the slots 22, 23, 29, 31 are separated by a separation web 41. This arrangement described here in detail is repeated with the 9 mm repeat on all frame legs 12, 13, 14, 16, as is shown clearly in FIGS. 2–4. In the direction of view of FIG. 2, a slot 42 is situated in the frame leg 16 exactly at right angles to the latter as well as the slot corresponding to the slot 29 situated behind it and not visible in FIG. 2. If axes were drawn through the centers of opposite slots, a rectangular system 43 of coordinates would result.

In the corner region between the frame leg 13 and the frame leg 14, a metal square 44 is welded in. At its right flank 46, it is butt-welded to the left end of the frame leg 13 with welds 47. With its other flank offset by 90° it is butt-welded by welds 48 to the frame leg 14. The center spacing of the slots 22, 29 from the flank 47 is 7 mm and this dimension is also maintained in relation to the other flank in the case of the first pair of slots of the frame leg 14. According to FIG. 4, the square 44 is symmetrical in relation to the geometric center plane 32. According to FIG. 2, its outer flank 49 is aligned with the outer contour line 51 of the frame leg 13 and its outer flank 52, at right angles to the latter, is aligned with the contour line 53 of the frame leg 14. The square 44 has a top flat end face 54 which is situated parallel to the center plane 32 and projects by a millimeter over the top side 56 of the longitudinal web 17. The bottom end face 57 is arranged analogously according to FIG. 4. A stepped borehole 58 passes through the square 44 at the place drawn. Its center piece situated symmetrically in relation to the center plane 32 is constructed as an internal thread 59. This merges at the top and at the bottom into a widened borehole 61, 62. Since the region of the square 44 was described very precisely, it is sufficient to mention that three further squares 63, 64, 66 are provided, which are of identical design and are arranged in a similar manner.

Since the frame legs 13, 16 are substantially longer than the frame legs 12, 14, a smaller square 67, 68 is welded in half way along in each case. However, said square does not disturb the arrangement of the slots and is welded in by welds 69 in a rectangular recess of the longitudinal flanges 17, 18. Its end face 71 is situated according to FIG. 4 at just the same height as the end face 54 and its bottom end face 72 is situated just as low as the end face 57. Additionally, the same stepped bore hole 73 is provided here, the center of which is aligned with the stepped bore hole in the square 44 and 46 in X-direction. The smaller square 68 is constructed analogously to the smaller square 67 and, here too, the center of the stepped bore hole is aligned, this time in Y-direction.

Figure 4:
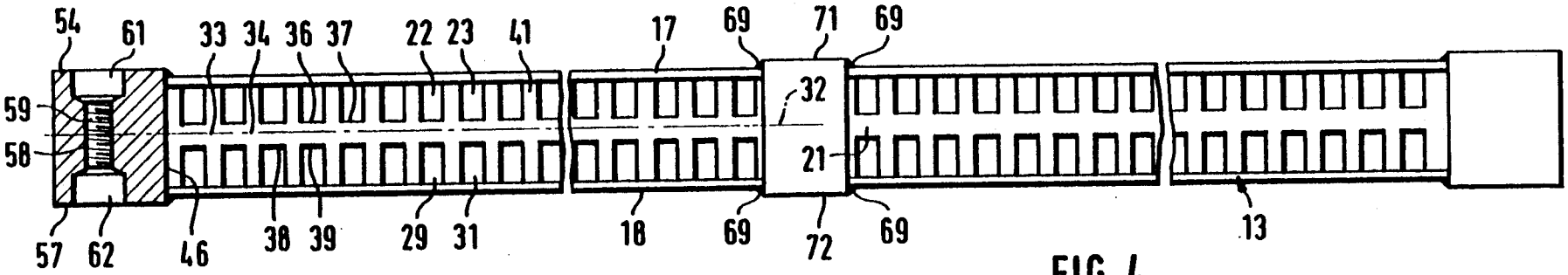
FIG. 4 shows a view according to the arrow 4 in FIG. 2.
Figure 3:
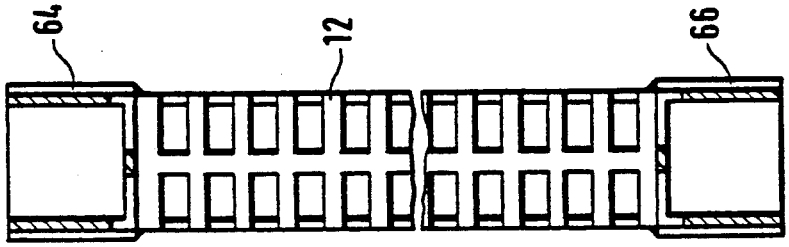
FIG. 3 shows a view according to the arrow 3 in FIG. 2.
Figure 8:
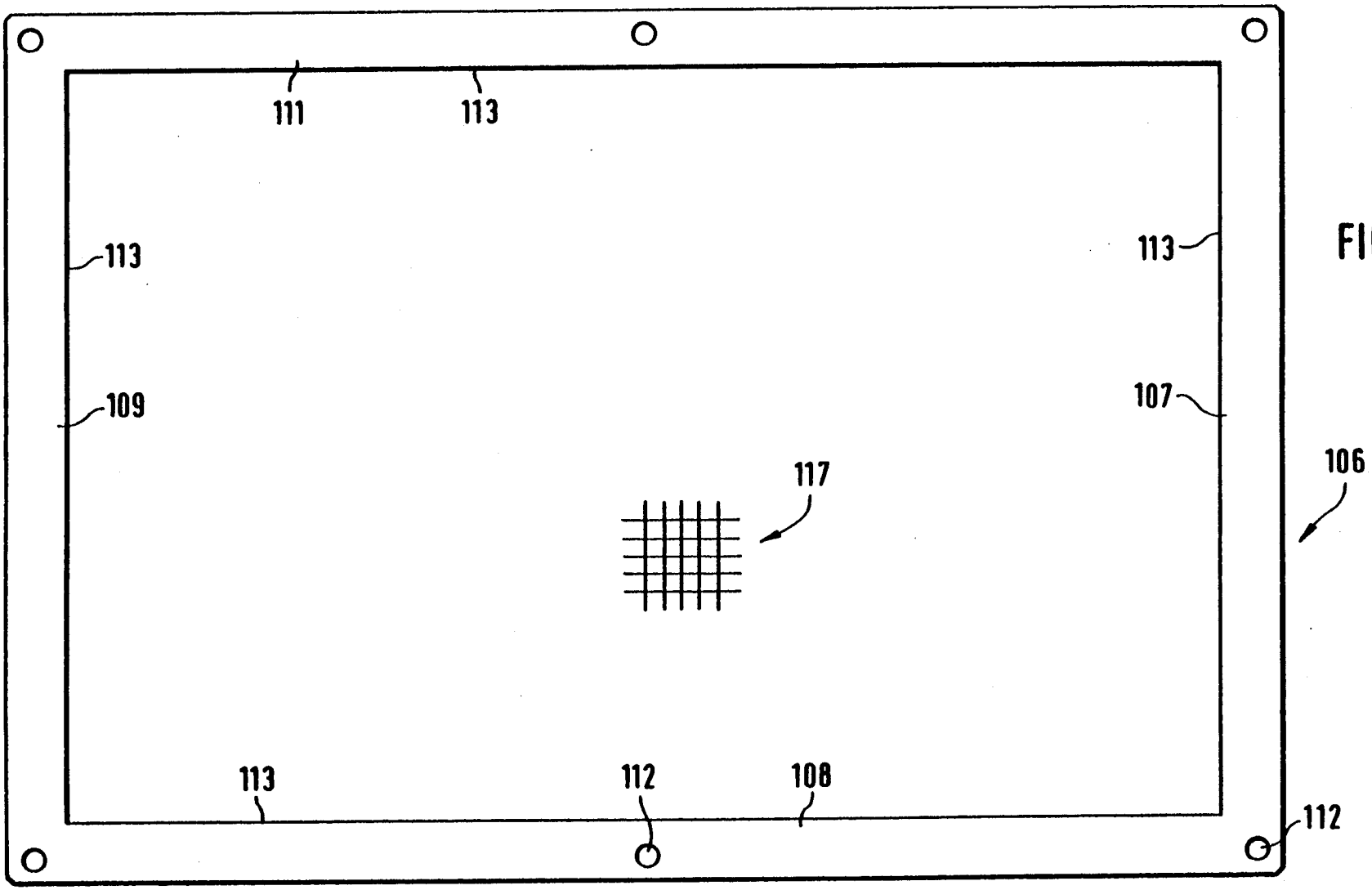
FIG. 8 shows the plan view of a holding-down frame.

The whole device illustrated in FIGS. 2 to 4—apart from the stepped bore holes—is coated with polyamide 0.4 mm thick. The clear dimension from frame leg 12 to frame leg 14 is 473 mm. A 480 mm long rack 74 fits in this direction according to FIG. 5. It is 10 mm high and thus fits in height into a slot equal to the slot 22, 23 in such a way that—depending on whether it is to be inserted with its teeth 76 upward or downward—it stops with the top or bottom region of its end face 77 on stop surfaces analogous to the stop surfaces 27, 28 according to FIG. 2 and can thus only be displaced in X-direction to a minimum extent. The rack 74 is coated with polyamide 0.4 mm thick, by which means on the one hand its surface is protected, on the other hand it does not damage the parts to be transported due to this relatively soft layer and, furthermore, it fits sufficiently loosely and without rattling in the slots 22, 23. The rack 74 is 4 mm wide and therefore fits in the 6 mm wide slots 22, 23 with a lateral play of 1 mm in each case. Since the rack 74 is of upright format with a height of 10 mm and a width of 4 mm, it cannot tilt in the slots.

Figure 5:
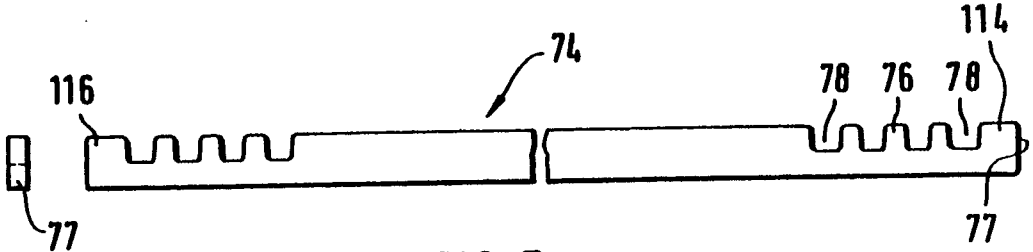
FIG. 5 shows the lateral view and front view of a rack, cut open.

Provided between the teeth 76 are rectangular gaps 78 which are cut in from above to a depth of 5.4 mm according to FIG. 5 and are thus cut in over slightly more than half the height of the rack 74. As shown in FIG. 1, a longitudinally dividing rack 74 and a correspondingly shorter transversely dividing rack can therefore be inserted meshing with one another such that a grid arises. This is also made possible by the fact that the gaps 78 with a width of 6 mm are slightly wider than the thickness of the racks 74 at 4 mm. Furthermore, the center spacing from gap 78 to gap 78 is 9 mm, i.e. equal to the center spacing of the slots 22, 23. Provision is then also made for the same number of gaps 78 to be provided as slots 22, 23 in the frame leg 13, 16. Finally, these gaps 78 are also aligned with the slots 22, 23 so that transversely dividing racks, which are inserted in the slots of the frame legs 13, 16, mesh in a cartesian form with the racks of the other direction. By Cartesian form or Cartesian grid we mean that longitudinally dividing racks intersect transversely dividing racks in a rectangular grid system. FIG. 1 shows directly and FIGS. 2 to 5 show indirectly that the same racks can optionally be inserted with the teeth downward or upward even in the slots 29, 31 open at the bottom, in which they are secured against dropping out by means which are yet to be explained.

Although the racks, taken alone, have a low rigidity, the cartesian system becomes rigid since the racks are not only held by the frame 11 at their ends, but along their length meshing racks hold each other.

Figure 7:
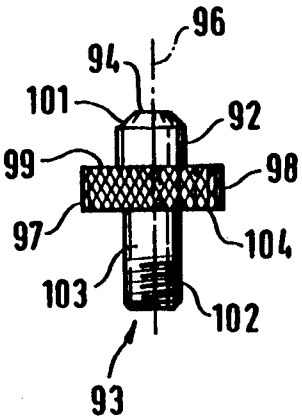
FIG. 7 shows the lateral view of a second foot.
Figure 6:
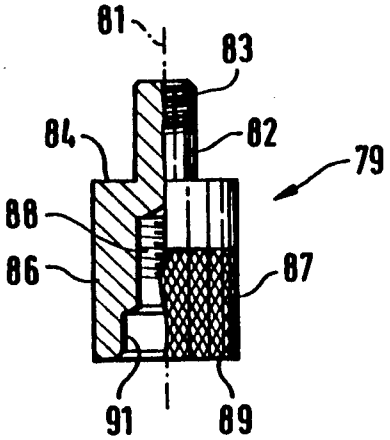
FIG. 6 shows the partially cut lateral view of a first foot.

A bottom foot 79 is rotationally symmetrical to its geometric longitudinal axis 81. A threaded bolt 82 bears an external thread 83 of the type M8 corresponding to the internal thread 59. Screwed in completely, an annular surface 84 bears from below on the end face 57. At the top, the annular surface 84 bounds a sleeve 86 which, with a diameter of 20 mm, does not project beyond the outer flank 49, 52. On the outside, the sleeve 86 bears a 1 mm cord 87. On the inside, a coaxial stepped bore hole 88 is provided, which is introduced from a bottom end face 89. A pin 92 of a top foot 93 fits in the bottom step 91 of greater diameter (12 mm) (FIG. 7). The bottom end face 89 as well as the annular surface 84 are parallel to the center plane 32. In the screwed-in state, this also applies to the end face 94 of the foot 93, the geometric longitudinal axis 96 of which is perpendicular to the center plane 32 and is substantially aligned with the longitudinal axis 81. Situated below the pin 92 is an annular collar 97 with a diameter of 20 mm, which collar likewise does not project beyond the outer flanks 49, 52 and bears on its circumference a 1 mm cord 98. In the stacked state, the bottom end face 89 of the foot 79 rests on an annular surface 99 of the the top foot 93 of another pallet and, inside the step 91, the pin 92 forms a positive-fit connection which centers itself due to the insertion slope 101. When the external thread 102 of the downward-facing threaded bolt 103 is screwed into the internal thread 59, the bottom annular surface 104 bears on the end face 54. The end faces of the threaded bolts 82, 103 do not touch under any circumstances in the stepped bore hole 58, not even when there are no further objects below the annular surfaces 84, 104, as will be explained later. The threaded bolts 82, 103 are appropriately short, but sufficiently long for the external threads 83, 102 to grip in any case even when there are objects lying below the annular surfaces 84, 104.

A holding-down sheet 106 consists of 1.5 mm thick sheet, it is flat and has four frame legs 107, 108, 109 and 111. These fit congruently on the frame legs 12, 13, 14, 16 together with the end faces 54, 71 of the squares 63, 64, 66, 67, 68. Provided in alignment with the geometric longitudinal axes of the stepped bore holes 58, 73 etc., are perforations 112, through which the threaded bolts 103 can pass. In the screwed-on state, the annular surfaces 104 press the regions around the perforations 112 onto the end faces 54, 71. The inside edge 113 of each frame leg 107, 108, 109, 111 is situated above the support surfaces 36, 37 so that the slots 22, 23 are also closed at the top so that the end regions 114, 116 of all the racks 74—irrespective of whether they extend in Y-direction or X-direction—are blocked in with little clearance. In the direction perpendicular to the plane 19 of the drawing, the end faces, directed in each case downward or upward, of the end regions 114, 116 either touch the resting surfaces 36, 37 or a surface further in from the inside edge 113.

The threaded bolt 103 is of such a length that its threaded 102 also screws into holding-down sheet 106.

If racks 74 are inserted in bottom slots 29, 31, an identical holding-down sheet 106 is used, which is screwed from below against the bottom feet 79.

If the racks 74 are only used as compartment divisions and do not support objects to be transported from below, a grid 117 must be provided in the free space between the frame legs 107, 108, 109, 111, which grid is of a sufficiently fine mesh for the parts and which, for example, is clamped between a bottom holding-down sheet 106 and the frame 11 or is welded to the inside edges 113.

Figure 9:
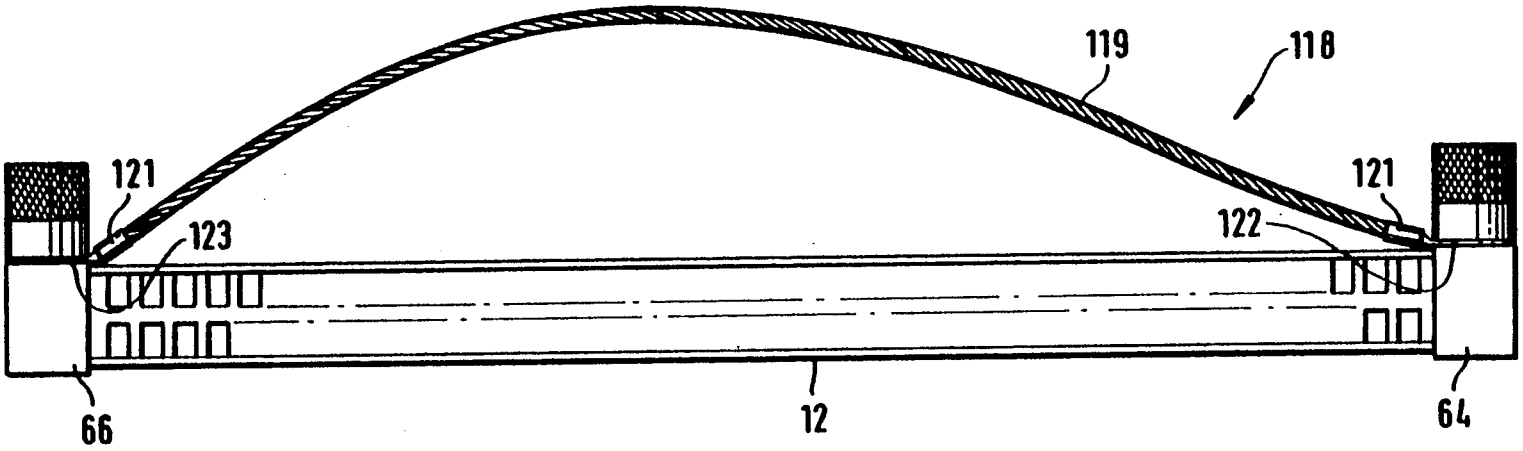
FIG. 9 shows a view according to arrow 9 in FIG. 2, but with handle and bottom feet which, in this case, are screwed on at the top.

According to FIG. 9, a handle 118 comprises a metal cable 119 which is slightly longer than the frame leg 12. Its ends are gripped in terminals 121 by cable loops 122 as are known, for example, from electric cable engineering. The cable loops have a thickness of 1 mm. The threaded bolt 82 passes through their loop hole and presses them onto the top end face of the squares 66, 64. A further holding-down sheet 106 would fit in thickness below the annular surface 84 and, nevertheless, the external thread 83 would screw into the internal thread of the squares 64, 66. The cable 119 has its place even if another frame were to be situated above it and it is always automatically in a position favorable for gripping when it is not stressed. The cable loops 122 could also be screwed to the top feet 93. To this effect, FIG. 9 shows that the feet 79 can also be used at the top and the feet 93 then used at the bottom when they are needed there.

I claim:

1. A transport pallet of rectangular contour for holding objects to be transported within said rectangular contour, having a bottom side including a planar area, having dimensions in the lower range of square decimeters up to a large number of square decimeters, said planar area including four corner regions, said transport pallet having spacer devices on said bottom side for spacing said transport pallet from an adjacent transport pallet, comprising:

a metallic frame covered with a protective coating that comprises four frame legs disposed in two pairs of approximately parallel frame legs, said pairs being approximately perpendicular to one another, said frame legs having receptacles extending approximately perpendicular to said planar area which receptacles in each frame leg are open towards an approximately parallel frame leg and have approximately the same shape as each other, said receptacles of each of said frame legs being in an opposed arrangement to said receptacles of a respective approximately parallel frame leg and having an open space between said receptacles, racks insertable at their ends in said receptacles, which racks have sides with teeth at least on one of said sides, with teeth gaps aligned with receptacles in frame legs approximately parallel to said racks, said teeth gaps being wider than said racks are thick, said racks having a length slightly shorter than said open space between opposite receptacles in said approximately parallel frame legs including receptacle depth.

2. Transport pallet as claimed in claim 1, wherein said frame legs comprise an inside and an outside, a U-shaped profile that is open toward said outside, an inside transverse web that extends substantially perpendicular to said planar area and top and bottom longitudinal flanges that extend approximately parallel to said planar area, wherein said receptacles comprise slots that, in length, are machined out of said transverse web and, in depth, out of at least said top longitudinal flange.

3. Transport pallet as claimed in claim 2, wherein said transverse web has a center, and said receptacles comprise slots starting from both said top longitudinal flange and said bottom longitudinal flange and extend in the direction of said center of said transverse web, which slots are aligned in pairs seen perpendicular to said transverse web, and wherein said transverse web has a material bridge between each pair of slots.

4. Transport pallet as claimed in claim 3, wherein said bridge is located in said center of said transverse web.

5. Transport pallet as claimed in claim 1, wherein center spacing from receptacle to receptacle is in the range of 5–15 mm.

6. Transport pallet as claimed in claim 1, wherein said receptacles are higher than they are wide.

7. Transport pallet as claimed in claim 1, wherein said racks are not substantially higher than said receptacles.

8. Transport pallet as claimed in claim 1, wherein said receptacles have stop surfaces, and said ends of said racks in an inserted state butt against said stop surfaces of said receptacles, which stop surfaces limit longitudinal movement of said racks.

9. Transport pallet as claimed in claim 8, wherein said stop surfaces comprise a base of said slots in said longitudinal flanges.

10. Transport pallet as claimed in claim 1, wherein said racks are metallic and are covered with a protective coating.

11. Transport pallet as claimed in claim 1, further comprising a holding-down frame attached to said frame, which holding-down frame overlaps said receptacles and said ends of said racks at least partially and prevents said racks from coming out of said transport pallet.

12. Transport pallet as claimed in claim 11, further comprising a screen, which extends parallel to said planar area, attached to said holding-down frame.

13. Transport pallet as claimed in claim 11, wherein said holding-down frame is made in one piece and has four metal legs.

14. Transport pallet as claimed in claim 1, further comprising reinforcement pieces connected rigidly to said four corner regions, provided in said frame legs in said four corner regions, and first feet attached at least indirectly to said reinforcement pieces at least in one direction perpendicular to said planar area by means of an attachment device.

15. Transport pallet as claimed in claim 14, wherein said first feet are adapted for stacking one of said transport pallets upon another.

16. Transport pallet as claimed in claim 15, wherein said first feet have a surface on which said transport pallet is arranged to stand and a recess open toward said standing surface.

17. Transport pallet as claimed in claim 16, wherein said recess is cylindrical.

18. Transport pallet as claimed in claim 14, wherein said attachment device has securely fitting elements.

19. Transport pallet as claimed in claim 14, wherein said attachment device has an internal thread in said reinforcement pieces, and said first feet each has a threaded bolt that is adapted to screw into said internal thread in said reinforcement pieces.

20. Transport pallet as claimed in claim 11, wherein said holding-down frame has four corner regions and perforations in said four corner regions, and portions of said first feet pass through said perforations, and said first feet have pressure surfaces facing said corner regions that press said holding-down frame onto said corner regions.

21. Transport pallet as claimed in claim 19, wherein said internal thread is a coarse-pitch thread in the self-locking range.

22. Transport pallet as claimed in claim 19, wherein said internal thread is a round thread.

23. Transport pallet as claimed in claim 14, wherein said first feet are substantially cylindrical.

24. Transport pallet as claimed in claim 14, wherein said first feet have a surface suitable for manual attaching said first feet to said reinforcement pieces.

25. Transport pallet as claimed in claim 24, wherein said feet surface is grooved.

26. Transport pallet as claimed in claim 16, wherein second feet of a type different from said first feet are attached in said four corner regions, aligned with an opposite said first feet, which second feet have an annular collar with a larger diameter than said recess.

27. Transport pallet as claimed in claim 26, wherein each of said second feet has a cone end for inserting said second feet into said recess in said standing surface on an adjacent transport pallet, said cone end being in front of said annular collar in a direction towards said standing surface on said adjacent transport pallet.

28. Transport pallet as claimed in claim 1, further comprising a moveable handle on two mutually parallel frame legs.

29. Transport pallet as claimed in claim 28, wherein said moveable handle comprises a cable.

30. Transport pallet as claimed in claim 29, wherein said frame legs each has a top side, and cable loops are provided at two ends of said cable, said cable loops being attachable to said first and said second feet on said top side.

* * * * *